United States Patent [19]

Buhr et al.

[11] Patent Number: 4,730,754

[45] Date of Patent: Mar. 15, 1988

[54] REFRACTORY IMMERSION TUBE PROVIDING LAMINAR FLOW OF MOLTEN METAL

[75] Inventors: Heinz Buhr, Meerbusch, Fed. Rep. of Germany; Jacques Brihay, Roux, Belgium; Manfred Winkelmann, Krefeld, Fed. Rep. of Germany

[73] Assignee: Didier-Werke AG, Wiesbaden, Fed. Rep. of Germany

[21] Appl. No.: 20,734

[22] Filed: Mar. 2, 1987

[30] Foreign Application Priority Data

Mar. 5, 1986 [DE] Fed. Rep. of Germany ..... 3607104

[51] Int. Cl.[4] ..... B22D 11/10

[52] U.S. Cl. ..... 222/594; 222/606

[58] Field of Search ..... 164/437, 337; 222/594, 222/606; 138/40, 44

[56] References Cited

U.S. PATENT DOCUMENTS 1,940,790 12/1933 Diehl ..... 138/44

FOREIGN PATENT DOCUMENTS 54-2508 1/1979 Japan ..... 138/44
56-33155 4/1981 Japan ..... 164/437
56-41053 4/1981 Japan ..... 164/437
2148765 6/1985 United Kingdom ..... 164/437
1118478 10/1984 U.S.S.R. ..... 164/437

*Primary Examiner*—Kuang Y. Lin
*Attorney, Agent, or Firm*—Wenderoth, Lind & Ponack

[57] ABSTRACT

A refractory immersion tube has an inner passage through which passes molten metal from a metallurgical vessel into a mold and includes an inlet opening for receiving the molten metal and at least one outlet opening extending from the passage for discharging the molten metal into the mold. A refractory annular member is positioned within the passage to restrict the cross-sectional area thereof, thereby to prevent the flow of the molten metal from the outlet opening from being turbulent and for ensuring that such flow is laminar.

10 Claims, 2 Drawing Figures

REFRACTORY IMMERSION TUBE PROVIDING LAMINAR FLOW OF MOLTEN METAL

BACKGROUND OF THE INVENTION

The present invention relates to a refractory immersion spout or tube for use in discharging molten metal from a metallurgical vessel into a mold under the static pressure of the molten metal. This type of immersion tube includes a central inner axial passage through which the molten metal passes from the metallurgical vessel to the mold, with the lower end of the immersion tube being immersed within the molten metal as it fills the mold. The passage includes an upper inlet opening for receiving the molten metal from the metallurgical vessel, and at a lower outlet end of the immersion tube are provided one or a plurality of outlet openings which discharge the molten metal into the mold.

A disadvantage of this type of immersion tube is that the molten metal flowing through the immersion tube tends to swirl and be turbulent. This swirling and turbulent movement results in the formation of waves or oscillations in the molten metal within the mold. Such waves or oscillations result in nonuniformities at the surface of the solidified metal slab within the mold. Such nonuniformities lower the quality of the slab since uneven surfaces increase the amount of scrap. Furthermore, uneven surfaces lead to high tolerances in the thickness of the case slab.

SUMMARY OF THE INVENTION

Accordingly, it is the primary object of the present invention to provide a refractory immersion tube of the above type but whereby it is possible to prevent, or at least substantially reduce, the formation of wave or oscillation movements in the upper surface of the molten metal within the mold.

This object is achieved in accordance with the present invention by the provision of means for preventing the flow of molten metal from the outlet opening of the immersion tube from being turbulent and for ensuring that such flow discharged into the mold is laminar, thereby preventing or at least substantially reducing the formation of wave or oscillation motions within the molten metal within the mold, and particularly at the upper surface thereof. This means is in the form of an annular member positioned within the passage of the immersion tube and restricting the cross-sectional area thereof. By postioning such annular member, having therethrough an orifice, within the free cross section of the immersion tube, the cross-sectional area of the passage through the immersion tube is reduced. This feature of the present invention changes the turbulent and swirling flow of molten metal to a laminar flow. Thus, it is possible to design the longitudinal section of the annular member and the position thereof within the passage through the immersion tube to ensure that the flow of molten metal at the outlet opening is laminar.

As a result, the molten metal flows quietly from the outlet opening or openings of the immersion tube into the mold, without imparting to the molten metal wave or oscillation motions. The in flowing molten metal does not cause wave or oscillation motions in the molten metal already in the mold. As a result, the finished molded product will have a smooth upper surface, and this represents a substantial quality improvement. By this arrangement, it also is possible to establish quality standards of the molded product within narrow limits, and specifically due to the formation of a smooth product surface without the incorporation thereinto of nonuniformities.

Furthermore, the feature of the present invention makes it possible to achieve a laminar flow in a relatively short immersion tube, and this makes it possible to employ the concept of the present invention in immersion tubes employed in sliding closure units, even when the distance between the metallurgical vessel and the mold is limited.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
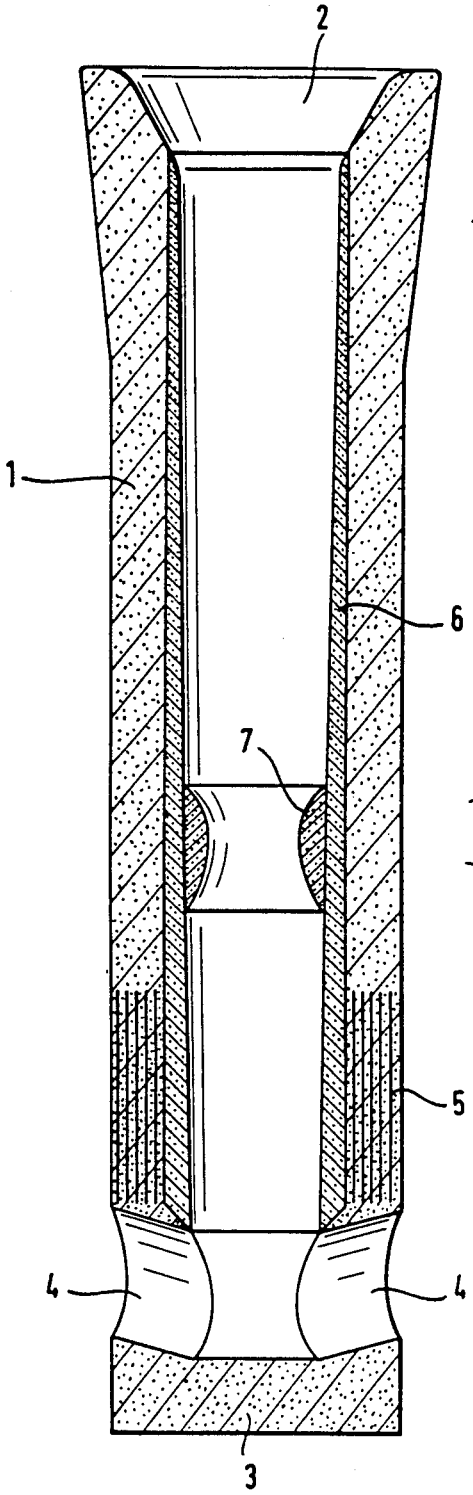
FIG. 1 is a longitudinal section through an immersion tube in accordance with one embodiment of the present invention.

FIG. 1 shows an immersion tube 1 according to a preferred embodiment of the present invention and including at an upper end thereof an inlet opening 2 to receive molten metal from a metallurgical vessel. The molten metal flow through an inner passage through the immersion tube and is discharged through outlet openings 4 provided above a bottom 3 of the immersion tube. One or a plurality of outlet openings 4 could be provided, and the shape and orientation thereof are intended to be conventional. Furthermore, the immersion tube may be provided with a reinforcement, shown at 5 and a conventional nature to provide added erosion resistance in that area of the immersion tube which is within the slag zone of a mold into which the immersion tube is inserted.

During use of known such immersion tubes, the molten metal flows under static pressure and is discharged through outlet openings 4 into the mold. Such flow of molten metal however swirls and is turbulent. This causes wave or oscillation motions in the molten metal within the mold, leading to nonuniformities on the surface of the molded product.

Figure 2:
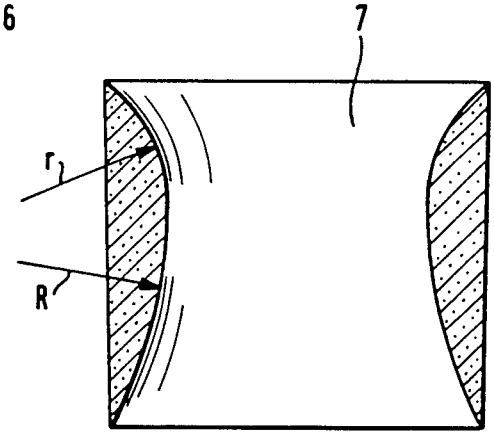
FIG. 2 is a longitudinal section, or an enlarged scale, through an annular member employed in the immersion tube of FIG. 1.

In accordance with the present invention however, this disadvantage is overcome by the provision of means for preventing the flow of molten metal from the outlet openings 4 from being turbulent and for ensuring that such flow is laminar. Particularly, within immersion tube 1 is provided an inner refractory tube 6 having an inner surface defining the central passage of the immersion tube and converging from the inlet opening 2 toward the outlet opening 4. Within the inner tube 6 is provided an annular member 7 having therethrough an orifice defined by a curved surface. The configuration of the curved surface, as shown in more detail in FIG. 2, includes, when viewed in longiudinal section, an upstream first surface portion defined by a radius of curvature r and a downstream second surface portion defined by a radius of curvature R. The radius of curvature r is less than the radius of curvature R, and the two surface portions converge smoothly. Annular member 7 restricts the cross-sectional area of the passage through the immersion tube. As a result, the swirling and turbulent flow of the molten metal is smoothed and made laminar. Particularly, the molten metal flow at the outlet openings 4 is made smooth and laminar. Thus, the above shape and design of annular member 7, as well as the tapering of inner tube 6, result in a laminar molten metal flow. Furthermore, renewed swirling and turbulence of the molten metal downstream of annular member 7 easily is avoided by proper positioning and dimensioning. This clearly would be understood by one of ordinary skill in the art from the present discussion. As a result, the molten metal emerges from outlet openings 4 quiescently and does not impart any wave or oscillation motions to the molten metal already in the mold.

Preferably, inner tube 6 and annular member 7 are formed of refractory material with a coefficient of heat expansion corresponding to that of the refractory material of immersion tube 1.

As shown in FIG. 1, annualr member 7 has an outer surface which is tapered in a manner corresponding to that of the taper of inner tube 6 such that annular member 7 seats in a complementary manner on the inner surface of the inner tube. Thus, annular member 7 simply can be pushed into inner tube 6, and the tapers of the surfaces of elements 6, 7 as well as the relative dimensions thereof readily may be designed to achieve seating or positioning of annular member 7 at a desired location along the passage.

It is to be understood however that appropriate design of annular member 7 would make it possible for the inner surface of inner tube 6 to not be tapered.

Further, it is contemplated to be within the scope of the present invention that annular member 7 and inner tube 6 could be formed unitarily of a single, integral element.

Furthermore, it is contemplated to be within the scope of the present invention that the annular member 7 be directly inserted into immersion tube 1, or even be formed integrally therewith, without the provision of inner tube 6.

Still further, it is contemplated to be within the scope of the present invention that the outlet openings 4 themselves could be formed in the configuration of the annular member 7 illustrated in the drawings, thereby to eliminate swirling or turbulent discharge of molten metal from outlet openings 4. In such case, the annular member 7 spaced upstream of the outlet openings would not be necessary.

It is to be understood that the various elements of the present invention would be formed of refractory materials which would be conventional and therefore understood by those skilled in the art. It furthermore is to be understood that the various sizes and dimensions of the various features of the present invention would be determined on a case-by-case basis depending upon a particular installation, and that such features also would be well within the understanding of one skilled in the art. The fundamental purpose of the present invention is to provide a restriction in the discharge flow of the molten metal to transduce swirling and turbulent flow thereof into smooth, quiescent and laminar flow. The relative position of the restriction, such as the annular member 7, within the discharge passage to achieve such purpose readily would be understood by one skilled in the art.

Although the present invention has been described and illustrated with respect to the preferred features thereof, it is to be understood that various changes and modifications may be made to the specifically described and illustrated features without departing from the scope of the present invention.

We claim:

1. In a refractory immersion tube for use in discharging molten metal from a metallurgical vessel into a mold under the static pressure of the molten metal, said immersion tube having an inner passage through which passes the molten metal and including an inlet opening for receiving the molten metal and at least one outlet opening extending from said passage for discharging the molten metal into a mold, the improvement comprising means for preventing the flow of molten metal from said outlet opening from being turbulent and for ensuring that said flow is laminar, said means comprising:

an annular member positioned within said passage and restricting the cross-sectional area thereof, wherein said annular member having therethrough an orifice defined by a curved surface including, in longitudinal section, an upstream first surface portion and a downstream second surface portion, said first surface portion being defined by a smaller radius of curvature than said second surface portion.

2. The improvement claimed in claim 1, wherein said annular member is of refractory material.

3. The improvement claimed in claim 1, wherein said annular member is spaced from said outlet opening.

4. The improvement claimed in claim 1, wherein said annular member is inserted into said immersion tube.

5. The improvement claimed in claim 4, wherein said immersion tube includes an inner surface defining said passage and converging toward said outlet opening, and said annular member includes an outer surface tapered to seat in a complementary manner on said inner surface of said immersion tube.

6. The improvement claimed in claim 1, further comprising an inner tube positioned within said immersion tube and defining said passage.

7. The improvement claimed in claim 6, wherein said inner tube and said annular member are formed of refractory material with a coefficient of heat expansion corresponding substantially to that of the refractory material of said immersion tube.

8. The improvement claimed in claim 6, wherein said inner tube includes an inner surface defining said passage and converging toward said outlet opening, and said annular member includes an outer surface tapered to seat in a complementary manner on said inner surface of said inner tube.

9. The improvement claimed in claim 1, wherein said annular member is formed of refractory material with a coefficient of heat expansion corresponding substantially to that of the refractory material of said immersion tube.

10. The improvement claimed in claim 11, wherein said at least one outlet opening extends laterally outwardly from said passage.

* * * * *